US007481339B1

(12) United States Patent
Hsu

(10) Patent No.: US 7,481,339 B1
(45) Date of Patent: Jan. 27, 2009

(54) HYGIENIC DISPENSING PACKAGE

(75) Inventor: Walter W. Hsu, Touliu (TW)

(73) Assignee: Medtech Products, Inc., Irvington, NY (US)

( * ) Notice: Subject to any disclaimer, the term of this patent is extended or adjusted under 35 U.S.C. 154(b) by 488 days.

(21) Appl. No.: 10/926,129

(22) Filed: Aug. 25, 2004

(51) Int. Cl.

| | |
|---|---|
| ***B65D 47/00*** | (2006.01) |
| ***B65D 43/12*** | (2006.01) |
| ***B67D 3/00*** | (2006.01) |
| ***F16K 3/00*** | (2006.01) |
| ***F16K 1/00*** | (2006.01) |

(52) U.S. Cl. ..... 222/561; 220/345.1; 251/326; 251/322; 215/322

(58) Field of Classification Search ..... 222/531, 222/559, 561; 215/322; 220/345.1; 251/326, 251/322

See application file for complete search history.

(56) References Cited

U.S. PATENT DOCUMENTS

| | | | | |
|---|---|---|---|---|
| 697,436 | A | 4/1902 | Betts | |
| 949,974 | A | 2/1910 | Cibulka | |
| 1,335,234 | A | 3/1920 | Hansen | |
| 1,815,069 | A | 7/1931 | Petro | |
| 1,884,813 | A * | 10/1932 | Nicholls | 222/480 |
| 2,089,812 | A | 8/1937 | Seigel | |
| 3,201,064 | A | 8/1965 | Dagle et al. | |
| 3,362,564 | A | 1/1968 | Mueller | |
| 4,257,537 | A * | 3/1981 | Uhlig | 222/153.14 |
| 4,284,204 | A | 8/1981 | Carey, Jr. | |
| 4,570,817 | A | 2/1986 | Hambleton | |
| 4,819,829 | A * | 4/1989 | Rosten et al. | 220/345.3 |
| 4,880,712 | A | 11/1989 | Gordecki | |
| 5,116,758 | A * | 5/1992 | Verma | 435/304.1 |
| 5,415,315 | A | 5/1995 | Ramirez | |
| 6,612,463 | B2 | 9/2003 | Hsu | |
| D521,876 | S | 5/2006 | Hsu | |
| D551,572 | S | 9/2007 | Hsu | |

* cited by examiner

*Primary Examiner*—Kevin P Shaver
*Assistant Examiner*—Melvin A Cartagena
(74) *Attorney, Agent, or Firm*—Baker Donelson Bearman Caldwell & Berkowitz PC

(57) ABSTRACT

A hygienic dispensing package includes a container having a top panel with a dispensing aperture selectively covered by a slide closure. The closure rides within a flat channel of the top panel and is in tongue and groove engagement with parallel side walls of the channel. One of a pair of spaced sockets in the channel is engaged by a detent formed on the underside of the closure when the aperture is covered; the detent seats in the other socket when the aperture is uncovered. The detent is formed as a protrusion on an integral cantilever leaf of the closure to assure intimate sliding contact between the faces of the channel and the closure and effective sealing of the aperture.

5 Claims, 2 Drawing Sheets

HYGIENIC DISPENSING PACKAGE

BACKGROUND OF THE INVENTION

1. Field of the Invention

The present invention relates generally to packaging and more particularly to hygienic dispensing packages having slide closures.

2. Antecedents of the Invention

Hygienic dispensing packages, particularly for nonedible objects to be placed in one's mouth, such as toothpicks, as well as for comestibles such as comfits and the like, presented challenges to those involved in package design.

Of paramount consideration was hygiene. Consumers sought assurance that foods or objects placed in their mouths were free of contaminants. Thus, the container was required to be adequately sealed when the contents were not being dispensed after initial purchase.

The provision of an adequate closure which would ensure against inadvertent loss of contents was also of significance. Screw on caps were often subject to being misplaced, leaving a dispensing opening unprotected.

Package cost factors were also significant, especially in connection with high volume/low cost items such as toothpicks. Additionally, toothpicks presented unique challenges with respect to closure constructions capable of repeated usage throughout the intended number of dispensing cycles until product depletion. Living hinge type lids have been employed, however, containers having such lids were not susceptible to efficient recycling, since the containers themselves were generally molded of clear food grade polystyrene, while the lids, having integral living hinges, were fabricated of polypropylene or polyethylene. Comingling of the different thermoplastics degraded the purity of the recycling waste stream.

SUMMARY OF THE INVENTION

The present invention meets the need in the art by providing a hygienic dispensing package, the package comprising a container having a channel having opposing side walls and a mating contact face therebetween, an aperture through the container for dispensing product to be packaged therein, the aperture being in communication with the channel, the package further including a slide closure, the slide closure being mounted for reciprocal movement in the channel, the slide closure having a contact face in sliding engagement with the mating contact face of the channel, the contact face of the channel including a socket and the contact face of the slide closure including a detent selectively extending into the socket to provide a limit stop for movement of the slide closure relative to the aperture, the slide closure including a cantilever leaf, the detent extending from the cantilever leaf, the cantilever leaf movable between a first position with the detent engaged in the socket and a second position with the detent withdrawn from the socket for moving the slide closure between a first position wherein the aperture is open and a second position wherein the aperture is closed, the slide closure being fabricated of thermoplastic resin and being formed of unitary one piece construction.

The resilient cantilever leaf flexes to facilitate engagement/disengagement of the detent, while permitting the remaining surfaces of the channel and the closure to lie in intimate sliding contact for assuring effective sealing of the aperture.

From the foregoing compendium, it will be appreciated that it is an aspect of the present invention to provide a hygienic dispensing package of the general character described which is not subject to the disadvantages of the antecedent history aforementioned.

It is a feature of the present invention to provide a hygienic dispensing package of the general character described which effectively seals contents against contaminants.

It is a consideration of the present invention to provide a hygienic dispensing package of the general character described which assures against inadvertent misplacement of a closure.

Another aspect of the present invention is to provide a hygienic dispensing package of the general character described which is simple to use.

A further feature of the present invention is to provide a hygienic dispensing package of the general character described which is low in cost.

Another consideration of the present invention is to provide a hygienic dispensing container of the general character described wherein components are fabricated of the same thermoplastic resin.

A further aspect of the present invention is to provide a hygienic dispensing package of the general character described which is well suited for economical mass production fabrication.

To provide a hygienic dispensing package of the general character described having a closure well suited to withstand repeated duty cycles until depletion of the full contents of the container is a package feature of the present invention.

Yet another consideration of the present invention is to provide a hygienic dispensing package of the general character described with an integral slide closure.

Yet a further aspect of the present invention is to provide a hygienic dispensing package of the general character described well adapted for automated production line container filling.

A still further feature of the present invention is to provide a hygienic dispensing package of the general character described which is well suited for fabrication with food grade thermoplastic resin.

Yet another consideration of the present invention is to provide a hygienic dispensing package of the general character described having a slide closure detent which does not exert stress on closure sealing surfaces.

Other aspects, features and considerations in part will be obvious and in part will be pointed out hereinafter.

With these ends in view, the invention finds embodiment in certain combinations of elements, arrangements of parts and series of steps by which the aforementioned aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown one of the various possible exemplary embodiments of the invention.

DESCRIPTION OF THE PREFERRED EMBODIMENT

Figure 1:
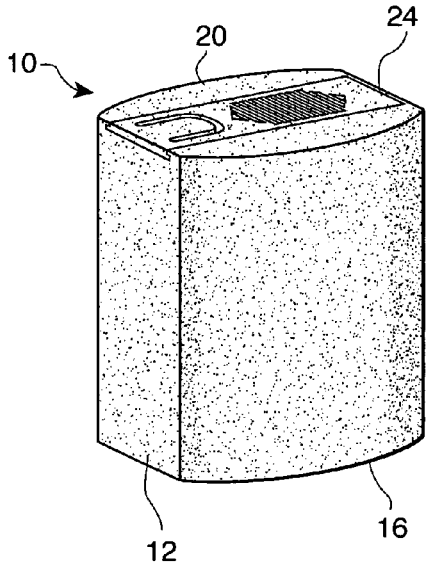
FIG. 1 is a perspective view of a hygienic dispensing package constructed in accordance with and embodying the invention and illustrating a slide closure seated within a flat channel of a package top panel and covering a dispensing aperture.

Referring now in detail to the drawings, a hygienic dispensing package constructed in accordance with and embodying the invention includes a container 10 having a pair of substantially planar parallel side walls 12, 14 and a pair of arcuate front and rear walls 16, 18. The container 10 is also provided with a planar bottom (not shown) and a top panel 20. The side walls, rear walls, top panel and bottom define exterior surfaces of the container 10.

The top panel 20 is configured with a flat channel 22 which extends axially from the side wall 12 toward the opposite side wall 14. Adjacent the side wall 14, the flat channel 22 terminates at a shoulder 24.

There is provided a dispensing aperture 26 which extends through the channel 22 from the side wall 14 an axial distance toward the side wall 12. Pursuant to the invention, a slide closure 28 is mounted for reciprocal movement within the flat channel 22 between a closed position, illustrated in FIG. 1, FIG. 3 and FIG. 5, to an open position, illustrated in FIG. 4, wherein the dispensing aperture 26 is unsealed.

The slide closure 28 includes a pair of parallel longitudinal edges 30, 32, each of which includes a tongue 34 which extends laterally from the respective longitudinal edge adjacent a lower contact face 36 of the slide closure 28.

The entire hygienic dispensing container 10, including the slide closure 28 is preferably fabricated of the same thermoplastic resin, such as polystyrene, for effective waste recycling.

Figure 3:
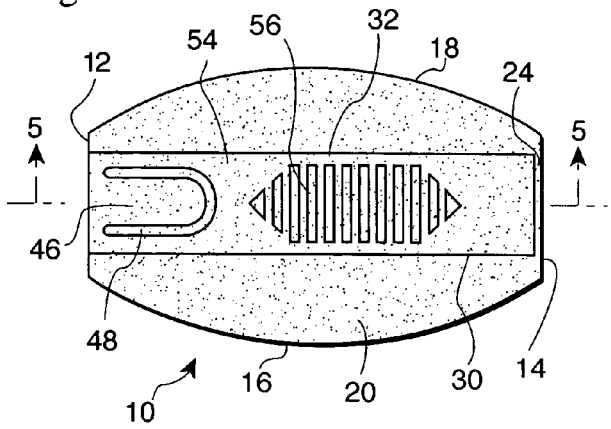
FIG. 3 is a top plan view of the hygienic dispensing package and illustrating an integral cantilever leaf formed in the slide closure as well as a finger grip tread on the upper surface of the closure.
Figure 2:
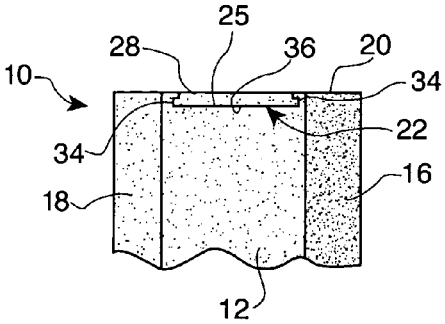
FIG. 2 is an enlarged fragmentary end view of the package illustrating a tongue and groove engagement between the side closure and side walls of the channel.
Figure 4:
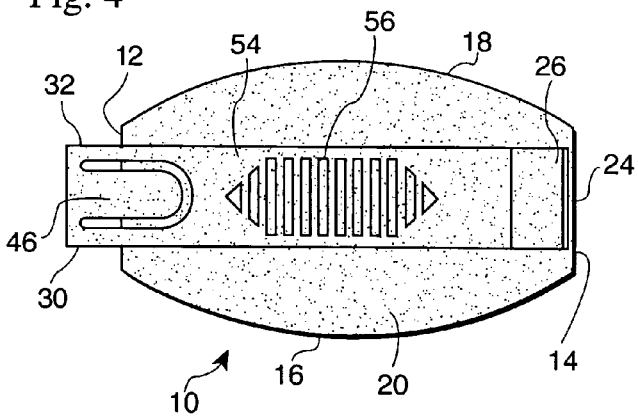
FIG. 4 is a top plan view of the hygienic dispensing package similar to FIG. 3 but showing the dispensing aperture opened.
Figure 5:
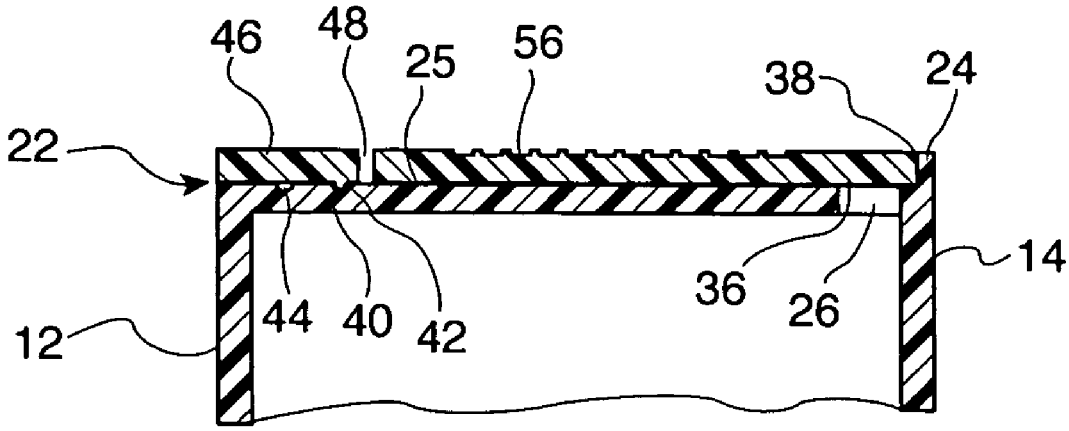
FIG. 5 is a fragmentary sectional view through the package, the same being taken substantially along the line 5-5 of FIG. 3 and illustrating a detent selectively engaged in one of two sockets formed in the flat channel, with the slide closure being positioned for sealing the aperture.

As illustrated in FIG. 2, the tongues 34 are received within undercut grooves formed in parallel side walls of the flat channel 22, such that the slide closure 28 may be moved between the position indicated in FIG. 3 and FIG. 5, wherein the dispensing aperture 26 is sealed, to the position indicated in FIG. 4, wherein the dispensing aperture is open and unsealed.

It should be noted that in the FIG. 3 and FIG. 5 slide closure position, a distal end 38 of the slide closure 28 is seated within a notch formed in the side wall 14, and abuts the shoulder 24. In such position, a detent 40 formed on the contact face 36 is seated in one of two axially spaced sockets 42, 44 which are formed in the flat channel 22.

It is significant that the detent 40 is formed within a partially cutout area of the slide closure 28, which comprises a cantilever leaf 46, defined by a generally U-shaped notch 48 extending through the thickness of the slide closure.

Figure 6:
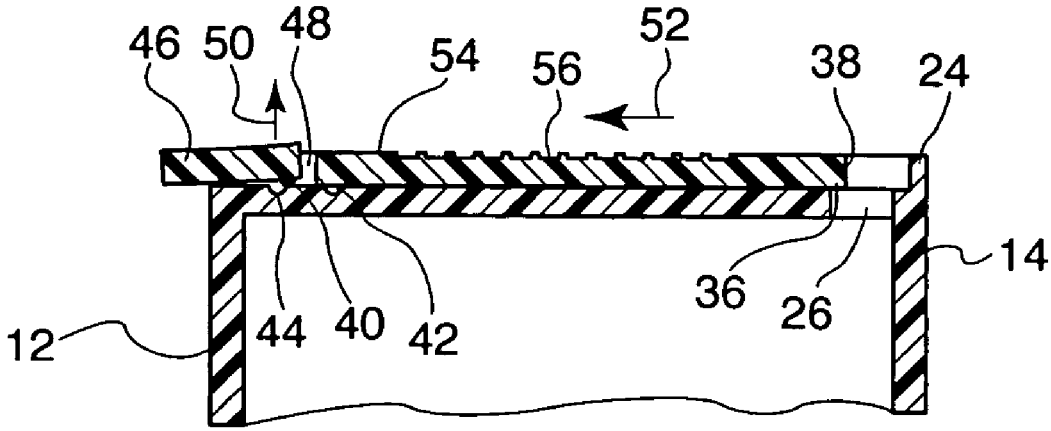
FIG. 6 is a fragmentary sectional view through the package, similar to that of FIG. 5, showing the slide closure in an intermediate position, with the dispensing aperture partially exposed.

The cantilever leaf 46 resiliently moves upwardly, away from the flat channel 22, as shown by the arrow 50 (FIG. 6), to disengage the detent 40 from one of the sockets, for example the socket 42. Such movement occurs when the slide closure 28 is moved toward the side wall 12, in a direction shown by the arrow 52 (FIG. 6), for the purpose of unsealing the dispensing aperture 26.

Because of the flexibility of the cantilever leaf 46, the remaining surface of the contact face 36 is substantially free of vertical forces encountered during disengagement between the detent 40 and the sockets 42, 44, thus assuring intimate surface contact between a contact face 25 of the flat channel 22 and the contact face 36 and assuring an effective seal of the dispensing aperture 26.

To facilitate the sliding movement of the slide closure 28, an upper face 54 of the slide closure 28 is provided with a grooved finger grip tread 56.

Upon the slide closure 28 being moved to a position fully opening the dispensing aperture 26, (illustrated in FIG. 4), the cantilever leaf returns to its original position causing the detent 40 to snap into the socket 44, which functions as an automatic limit stop.

To close the dispensing aperture 26 after dispensing a desired quantity of the container contents, the slide closure 28 is urged in a direction opposite that of the arrow 52. The cantilever leaf 46 then moves upward, to release the detent 40 from the socket 44. When the distal end 38 of the slide closure abuts the shoulder 24, the detent 40 snaps into the socket 42 and the dispensing aperture 26 is completely resealed.

It should be understood that although only two sockets 42, 44 have been illustrated, one or more intermediate sockets may be provided between the sockets 42 and 44 for the purpose of providing intermediate stops of slide closure movement wherein the dispensing aperture 26 is partially opened, for example, wherein it is desired that only a single piece or unit of container contents be dispensed.

Thus it will be appreciated that there is provided a hygienic dispensing package of the general character described which achieves the various aspects, features and considerations of the present invention and which is well suited to meet the conditions of practical usage.

Since various possible embodiments might be made of the present invention and since various changes might be made in the exemplary embodiment shown herein without departing from the spirit of the invention, it should be understood that all matter herein described or shown in the accompanying drawings should be interpreted as illustrative and not in a limiting sense.

Having thus described the invention, there is claimed as new and desired to be secured by Letters Patent:

1. A hygienic dispensing package, the package comprising a container having a channel having opposing side walls and a mating contact face therebetween, an aperture through the container for dispensing product to be packaged therein, the aperture being in communication with the channel, the package further including a slide closure, the slide closure being mounted for reciprocal movement in the channel, the slide closure having a contact face in sliding engagement with the mating contact face of the channel, the contact face of the channel including a socket and the contact face of the slide closure including a detent selectively extending into the socket to provide a limit stop for movement of the slide closure relative to the aperture, the slide closure including a cantilever leaf, the detent extending from the cantilever leaf, the cantilever leaf movable between a first position with the detent engaged in the socket and a second position with the detent withdrawn from the socket for moving the slide closure between a first position wherein the aperture is open and a second position wherein the aperture is closed, the slide closure being fabricated of thermoplastic resin and being formed of unitary one piece construction.

2. The hygienic dispensing package as constructed in accordance with claim 1 wherein the mating contact face of the channel includes a plurality of sockets.

3. The hygienic dispensing package as constructed in accordance with claim 1 wherein the dispensing container includes a top panel, the aperture extends through the top panel and the channel is formed in the top panel.

4. The hygienic dispensing package as constructed in accordance with claim 3 wherein the aperture extends through the mating contact face of the channel.

5. The hygienic dispensing package as constructed in accordance with claim 1 wherein the container and the slide closure are formed of the same thermoplastic resin.

* * * * *